US006186191B1

(12) United States Patent
Dornier et al.

(10) Patent No.: US 6,186,191 B1
(45) Date of Patent: Feb. 13, 2001

(54) ARRANGEMENT FOR MONITORING FUNCTIONALITY OF FLEXIBLE PRESSURE HOSES IN A LOOM

(75) Inventors: Peter D. Dornier, Nonnenhorn; Herbert Mueller, Kressbronn, both of (DE)

(73) Assignee: Lindauer Dornier Gesellschaft mbH, Lindau (DE)

( * ) Notice: Under 35 U.S.C. 154(b), the term of this patent shall be extended for 0 days.

(21) Appl. No.: 09/625,297

(22) Filed: Jul. 25, 2000

(30) Foreign Application Priority Data

Jul. 30, 1999 (DE) ..... 199 36 071

(51) Int. Cl.[7] ..... D03D 47/28; D03D 51/06

(52) U.S. Cl. ..... 139/435.1; 139/336; 138/36

(58) Field of Search ..... 139/435.1, 435.2, 139/435.3, 336, 340, 370.1, 370.2, 435.4, 435.5; 340/320; 138/36, 177, 178; 73/40.5 R, 865.8, 432.1

(56) References Cited

U.S. PATENT DOCUMENTS

H1057 * 5/1992 Regalia ..... 340/320
646,886 * 4/1900 Stowe et al. ..... 340/320
3,845,657 * 11/1974 Hall et al. ..... 138/36
5,031,669 * 7/1991 Wahhoud et al. ..... 139/370.2
5,295,515 * 3/1994 Kato ..... 139/435.1
5,440,495 * 8/1995 Sainen et al. ..... 364/470.11
6,021,820 * 2/2000 Cox ..... 139/435.1

* cited by examiner

*Primary Examiner*—Danny Worrell
(74) *Attorney, Agent, or Firm*—W. F. Fasse; W. G. Fasse

(57) ABSTRACT

A fluid jet loom includes a source of pressurized fluid, a magnetic valve, and at least one nozzle, such as a weft insertion air jet nozzle, as well as at least one flexible pressure hose connecting and providing pressurized fluid from the magnetic valve to the nozzle. In order to detect any hole, rupture or separation of the pressure hose, the hose includes at least one electrical conductor embedded in or arranged on the hose wall. An electrical current flows through the electrical conductor, which preferably forms a conductor loop and especially a resonant circuit loop. By monitoring an electrical characteristic, such as the resonant frequency, of the electrical signal received from the conductor loop, any disruption in the pressure hose can be immediately detected as a change in the monitored electrical characteristic, which in turn causes a loom stop signal to be generated.

23 Claims, 2 Drawing Sheets

ARRANGEMENT FOR MONITORING FUNCTIONALITY OF FLEXIBLE PRESSURE HOSES IN A LOOM

PRIORITY CLAIM

This application is based on and claims the priority under 35 U.S.C. §119 of German Patent Application 199 36 071.5, filed on Jul. 30, 1999, the entire disclosure of which is incorporated herein by reference.

FIELD OF THE INVENTION

The invention relates to a monitoring arrangement for fluid jet looms having flexible pressure hoses as components of a weft thread insertion system, whereby these pressure hoses respectively connect at least one pressure source with at least one electrically actuatable magnetic valve, and/or connect at least one electrically actuatable magnetic valve with fluidic weft insertion devices, e.g. fluid jet nozzles.

BACKGROUND INFORMATION

Fluid jet looms conventionally include a source of pressurized fluid, a main or primary weft insertion nozzle and a plurality of auxiliary weft insertion nozzles, as well as a plurality of individual flexible pressure hoses that connect the pressure source to the several nozzles. Electrically actuatable magnetic valves are also typically interposed between the pressure source and the nozzles, in order to control the supply of pressurized fluid from the source to the nozzles, according to a program being executed by the general loom controller. In this regard, the main weft insertion nozzle inserts a weft thread into an open loom shed as pressurized fluid is supplied to this nozzle, and then the auxiliary nozzles carry the inserted weft thread across the width of the open shed, for example along a weft insertion channel provided in the reed of the loom. In a typical air jet loom, the pressure source is a source of pressurized air, and the nozzles are corresponding air jet nozzles. Alternatively, a liquid, such as water may be provided from the pressure source to drive appropriate water jet nozzles.

In the operation of such fluid jet looms, the flexible pressure hoses are subjected to a great variety of loads and stresses during the weaving process. Such loads and stresses include bending loads and stresses at the terminal hose connections, as well as pressure loads and stresses of the entire hose and its connections as a result of the repetitive increasing and decreasing of the pressure within the hose during the course of the weaving operation. Since the magnetic valves controlling the flow of the pressurized fluid cycle open and closed during the weaving operation, there is a corresponding drastic and rapid variation of pressure in the associated pressure hoses. Also, the vibration and motion of various mechanical components of the loom cause corresponding vibration and motion of the pressure hoses and the hose connections provided at the ends of the hoses.

These various loads and stresses cause long term fatigue of the pressure hoses and their terminal hose connections, as well as sudden drastic failure such as a rupture or leakage due to an overload or the like. More generally, the above mentioned loads and stresses lead to various types of defects in the pressure hoses, from leakage points such as pinpoint holes or ruptures along the length of the hose, to a complete rupture or separation of the hose from its terminal hose connection, for example. The pneumatic or hydraulic fluid (e.g. air or water) leaking out of the hose as a result of such defects causes a reduction of the effectiveness of the associated main weft insertion nozzle and/or auxiliary nozzles connected to the affected hose.

Such a reduction in the operating effectiveness of the fluid nozzles due to defects in the pressure hoses has never yet been monitored or detected in conventional looms up to the present date. The reduction in the operating effectiveness of the weft insertion system necessarily ultimately leads to problems and defects in the weft insertion, which may, however, not be immediately recognized after their occurrence by the operator of the loom. Rather, there is a significant danger that the reduction in weft insertion effectiveness will go unnoticed and uncorrected for an extended period of time during the operation of the loom. As a result, defective weft insertions can be carried out during this period time, and the resulting defectively inserted weft threads will remain as permanent weave defects in the finished woven fabric. This is especially true when the above mentioned defects in the pressure hoses result in only minor leakage at first, but become progressively worse over time, because such a progressive worsening may not be recognized. Thus, the reduction in the weft insertion effectiveness and the corresponding increase in weft defects that is caused by a defective pressure hose in the weft thread insertion system of the loom can lead to the production of a considerable quantity of defective reject fabric, until eventually the operator of the loom notices the defects in the woven fabric and shuts down the loom.

SUMMARY OF THE INVENTION

In view of the above it is an object of the invention to provide a system and a method for carrying out a permanent monitoring of the proper functionality of the pressure hoses, and particularly the pressure hoses included in the weft thread insertion system of a fluid jet loom, in order to ensure that any defect or deficiency in the functionality of the hoses is immediately detected and indicated, and may be used to trigger a stop of the loom. The invention further aims to avoid or overcome the disadvantages of the prior art, and to achieve additional advantages, as apparent from the present specification.

The above objects have been achieved according to the invention in an improved monitoring arrangement in a loom provided with a fluid jet weft insertion. The overall apparatus comprises a pressurized fluid supply arrangement (e.g. including a pneumatic or hydraulic pressure source and at least one electrically actuatable magnetic valve), at least one fluid jet nozzle arrangement (e.g. including a fluid jet nozzle for inserting a weft thread into a loom shed and at least one fluid jet nozzle for drawing and tensioning the inserted weft thread at the downstream side of the weaving width), and flexible pressure hoses connecting the pressurized fluid supply arrangement (e.g. the valves) to the nozzles. Especially according to the invention, the pressure hoses include a base hose wall material such as a rubber or synthetic plastic hose wall, as well as at least one electrical conductor arranged on or in the hose wall. The electrical conductor provided in or on the pressure hose is connected directly or indirectly to a detection circuit, which may be a separate circuit or may be incorporated in the loom controller. When a defect occurs in a pressure hose, the electrical conductor in the hose is broken, interrupted or otherwise altered. As a result, an electrical current conducted through the conductor is interrupted or altered, which can be detected by the loom controller or separate detection circuit, which then releases a signal indicating a defect in the respective pressure hose, or directly triggers a loom stop.

The above objects have further been achieved according to the invention in a method of operating the above described system or arrangement. In this method, an electrical current or signal is conducted through the electrical conductor provided in the pressure hose. An electrical characteristic of the electrical signal is continuously or intermittently monitored by the provided detection circuit or directly by the loom controller. In this context, the electrical characteristics are, for example, the magnitude of the current conducted through the electrical conductor of the hose, the voltage measured along the length of the hose, the resistance measured along the length of the hose, or the resonant frequency of a resonant circuit including the electrical conductor as a circuit component. Any variation of the measured electrical characteristic outside of an acceptable range, or beyond an acceptable threshold, is interpreted as an indication that a defect or rupture has occurred in the respective associated pressure hose. As a result, a defect signal is triggered or released, which is visually or audibly indicated to the operator of the loom, or may directly result in the automatic stopping of the loom.

The at least one electrical conductor provided in or on the pressure hose may be a single conductor, two conductors connected in an open loop or closed loop, or a greater plurality of conductors, or even a continuous sleeve or jacket of conductive metal together with a return conductor isolated from the conductive sleeve, or a woven braid jacket of conductive wires or the like also cooperating with a separate return conductor. The greater the number of conductors or the greater the surface coverage and distribution of conductors over the surface of the pressure hose, the greater is the sensitivity of the system to detect even small defects or breaks in the hose, for example such holes or breaks that do not result in the total rupture or separation of the hose.

In a preferred embodiment of the invention, the electrical conductor or conductors in the pressure hose form a closed conductor loop extending along the length of the pressure hose within the wall of the pressure hose. In cooperation with an oscillating coil, the closed conductor loop forms an oscillating resonant circuit with a predetermined resonant frequency. This resonant frequency, and in general the resonant behavior of the closed conductor loop, can be detected and measured using generally conventional circuit elements in a detector circuit. When the detector circuit continuously or intermittently monitors the frequency of the resonant closed loop of the conductors in the respective pressure hose, any variation of this frequency during the weaving operation will be detected and recognized in the detection circuit. Any variation in this frequency at all, or a variation that exceeds a certain prescribed threshold, will be evaluated as a significant feature of the signal, which is indicative of the functionality of the associated pressure hose of the weft insertion system. Thus, a corresponding signal such as an electrical signal or an optical signal will be triggered upon the detection of such a significant variation of the resonant frequency. This signal may be indicated to the operator of the loom in order to carry out a manual stopping of the weaving process, or may be used directly in the loom controller to carry out an automatic interruption and stopping of the weaving process.

The method and arrangement according to the invention advantageously ensure that any defect or other functional interference that is developing or has already occurred in a pressure hose of the weft insertion system can be detected at the earliest possible time, and can then lead to the stopping of the weaving process. In this manner, the invention helps to avoid producing a large amount of defective woven fabric before a weaving defect is noticed and the cause of such a defect is tracked down or related to a leak or rupture of a pressure hose.

BRIEF DESCRIPTION OF THE DRAWINGS

In order that the invention may be clearly understood, it will now be described in connection with example embodiments, with reference to the accompanying drawings, wherein.

DETAILED DESCRIPTION OF PREFERRED EXAMPLE EMBODIMENTS AND OF THE BEST MODE OF THE INVENTION

Figure 1:
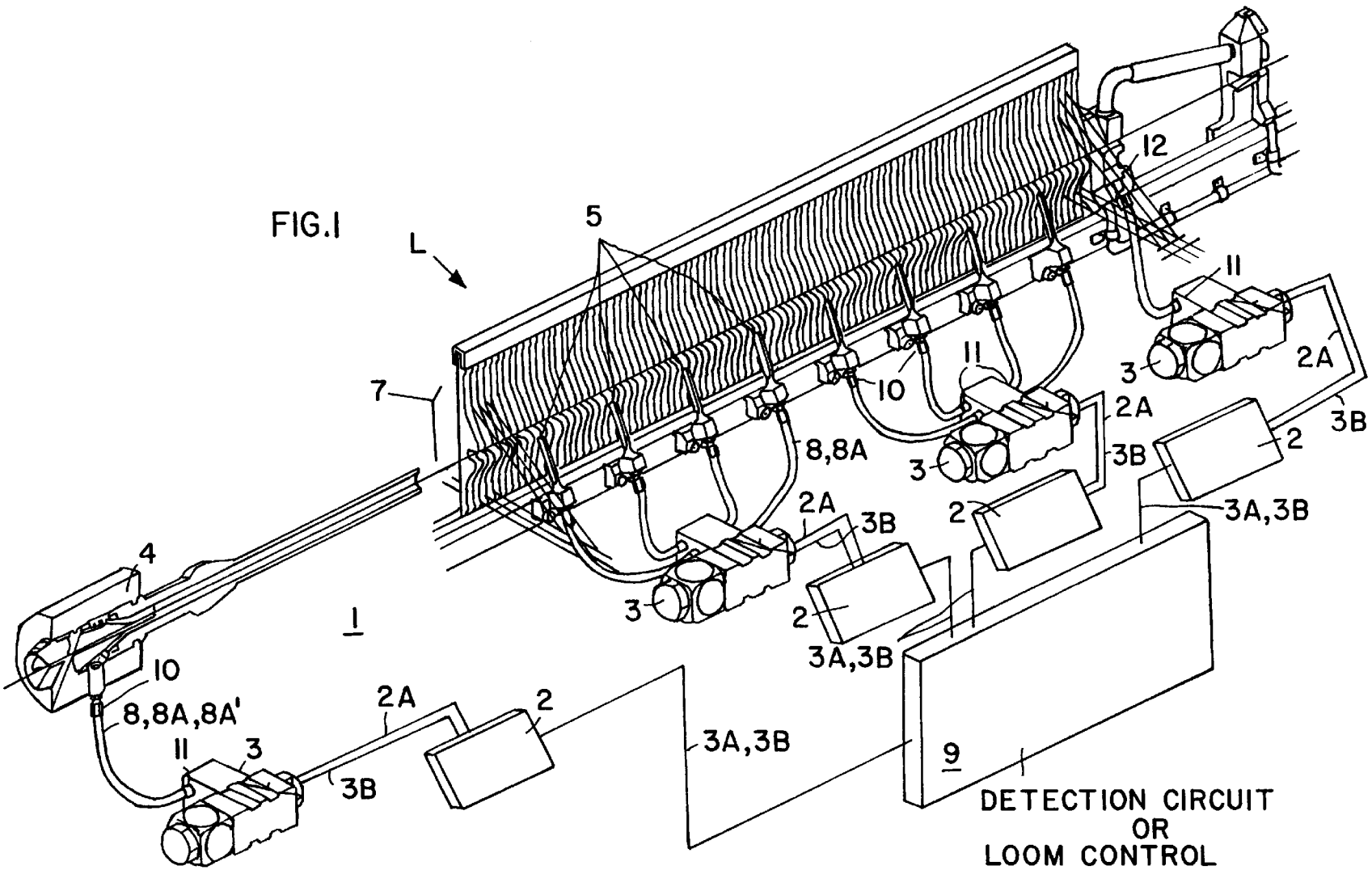
FIG. 1 is a schematic perspective overview of the weft insertion system of a fluid jet loom, equipped with pressure hoses according to the present invention.

FIG. 1 schematically shows a portion of an air jet loom L, and particularly components of the weft thread insertion system 1 of the loom L. The weft thread insertion system 1 includes at least one pneumatic pressure source 2, and in the illustrated embodiment four pneumatic pressure sources 2. The weft thread insertion system 1 further includes means for inserting a weft thread 6 into a loom shed 7, e.g. fluid jet nozzles, including a main weft insertion nozzle 4 and a plurality of auxiliary nozzles 5 distributed across the weaving width, as well as a weft drawing or tensioning nozzle 12 arranged on the downstream side of the weaving width. A plurality of electrically actuated magnetic control valves 3 are provided to control the supply of pressurized air from the pressure sources 2 to the several nozzles 4, 5 and 12. Moreover, pressure lines 2A (such as rigid conduits or flexible hoses) connect the pressure sources 2 to the valves 3, and flexible pressure hoses 8 provide a fluid connection respectively from these valves 3 to the associated nozzles 4, 5 or 12. Each magnetic valve 3 comprises one or more valve outlets 11 (with corresponding hose end connectors) to which the respective pressure hoses 8 are connected. At the other end of the pressure hoses, each hose is provided with a hose connector 10 that is secured to an inlet port of the associated nozzle 4, 5 or 12. Thus, pressurized air is provided from the pressure sources 2 through pressure lines or conduits 2A to the respective magnetic valves 3, and from there through the flexible pressure hoses 8 to the respective nozzles 4, 5 or 12.

In order to electrically actuate the magnetic valves 3, these are each connected by first signal lines 3A to an electronic detec tion circuit or the general loom controller 9. Second signal lines 3B run parallel to the first signal lines 3A. These second signal lines 3B are isolated or insulated from each other, but are connected on the one hand to the valve outlets 11 of the magnetic valves 3, and on the other hand to the detection circuit or loom controller 9. Thus, the second signal lines 3B also extend from the pressure sources 2 to the respective valves 3, whereby the electrical connection can be established along or via the pressure lines 2A, or separately therefrom.

In order to allow an electronic or electrical monitoring of the proper functionality of the pressure hoses 8, each pressure hose 8 comprises a pressure hose wall 8' as well as at least one electrical conductor 8A or 8A' integrated in or provided on the hose wall 8'. Particular detail embodiments of the arrangement of the conductors 8A and 8A' will be described below. In general, an electrical signal or current flows through the conductors 8A and/or 8A' in each pressure hose 8, being provided from and/or to the second signal lines 3B, through the valve outlets 11. It should be understood that each valve outlet 11 includes or corresponds to a hose connection 11 by which the hose 8 is connected to the valve 3, both pneumatically, and in an electrically conducting manner to provide an electrical conduction between the conductors 8A and 8A' of the hose 8 and the associated second signal line 3B.

If a defect such as a hole, rupture or separation of a pressure hose 8 arises along the length of the pressure hose 8, or directly at one of the hose connections 10 or 11, the electrical conductors 8A and 8A' provided in the hose 8 will be at least partially or completely broken, interrupted, or otherwise altered. As a result, an electrical characteristic, such as the voltage, current, resistance, or resonant frequency of an electrical signal conducted through the conductors BA and 8A' will be correspondingly altered or interrupted. This alteration or interruption of the electrical characteristic being monitored will correspondingly trigger, from the loom controller or detection circuit 9, a signal that can be directly or indirectly used for stopping the weaving process.

The particular construction and arrangement of the current carrying conductors 8A and 8A', and their integration into each pressure hose 8, as well as the manner of the current conduction and contacting of these conductors 8A and 8A' with the valve outlet or hose connection 11 of the magnetic valves 3 and/or the hose connection 10 at the associated nozzles 4, 5 or 12 can be carried out in various manners, for example as represented in FIGS. 2 to 6.

Figure 4:
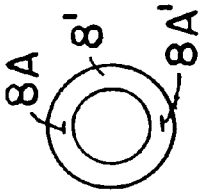
FIG. 4 is a view similar to that of FIG. 3, but showing a second embodiment of the electrical conductors provided in the hose.
Figure 3:
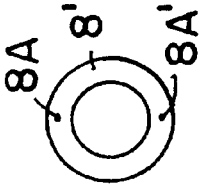
FIG. 3 shows a first embodiment of the hose of FIG. 2, as seen in a section or an end view in the direction of arrow III in FIG. 2.
Figure 6:
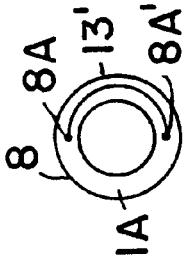
FIG. 6 is a sectional view of the pressure hose having an open conductor loop, as seen along the section line VI—VI in FIG. 5.
Figure 2:
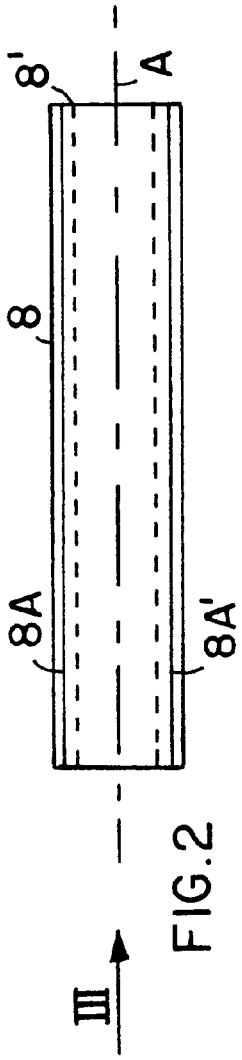
FIG. 2 is a schematic side view of a pressure hose according to the invention, for use in the loom of FIG. 1.

FIG. 2 is a general side view of a pressure hose 8 having conductors 8A and 8A' embedded in the hose wall 8'. FIGS. 3 and 4 show two different embodiments in the manner of cross-sections or end views of the hose 8 according to FIG. 2. In FIG. 3, two electrical conductors 8A and 8A' are shown embedded in the hose wall 8'. These two conductors 8A and 8A' can be understood as extending straight along the length of the hose 8, i.e. parallel to the axis A of the hose (where the terms "straight" and "parallel" are intended to apply when the hose is in a straight linear configuration, and allow for similarly curved conductors when the hose is in a curved configuration). Each conductor 8A is a wire having a substantially round cross-section. In an alternative embodiment of FIG. 4, the two conductors 8A and 8A' can be understood as extending along the length of the hose 8 parallel to the axis A, whereby each conductor 8A or 8A' has a flattened and arcuate cross-section, such as an arcuate curved sheet or film of conductive material.

Alternatively, the conductors 8A and 8A' in FIG. 4 can be understood as two substantially round or cylindrical conductors that are wrapped in a spiral fashion so that they form a helix around the axis A. In the section plane or end view plane of FIG. 4, only a short portion of the spiralling extension of each conductor 8A or 8A' is visible. The two conductors 8A and 8A' may spiral in the same helix direction or in opposite helix directions so as to form a mesh such as a woven mesh jacket within the hose wall 8' or around the exterior of the hose 8.

The number of conductors can be increased beyond two, for example 6, 7 or 8 conductors extending in parallel along the hose or spiralling around the axis of the hose. By providing an increased number of conductors, the sensitivity to detect even minor defects in the hose is increased. The several conductors may be connected to each other electrically in series or in parallel. For example, if the ends of adjacent ones of the conductors are connected in series to each other, the electrical current flowing through the conductors can be caused to flow several times back and forth along the length of the respective hose successively in the successive serial conductors 8A and 8A'. A break in any one of the conductors will thus interrupt the entire current flow in the series arrangements of conductors. On the other hand, if the conductors are connected in parallel, then a break of any one conductor will not totally interrupt the current flow, but will still cause a detectable variation in the current, voltage, and resistance of the conductor arrangement.

Figure 5:
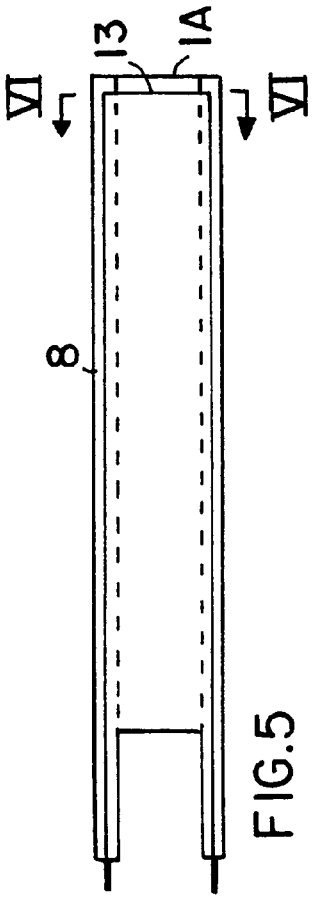
FIG. 5 is a schematic side view of a pressure hose having electrical conductors forming an integrated open conductor loop according to the invention.

FIG. 5 shows an arrangement in which two conductors 8A and 8A'running along the length of the hose 8 are not connected to each other at the free terminal ends (at the left end of the hose 8 in FIG. 5), but are connected to each other at the right end of the hose, so as to form an open conductor loop 13. In such an arrangement, the conductor path can be completed by a hose connector 10 or 11 at the right terminal end of the hose 8. Alternatively, a conductor bridge 13' as shown in the sectional view of FIG. 6 can be provided to connect the right ends of the conductors 8A and 8A' to each other. In either case, the open loop 13 allows an electrical signal or current to be fed from a power supply into one of the conductors 8A, and then a resulting information signal is fed from the free terminal end of the other conductor 8A' to the detection circuit.

Figure 7:
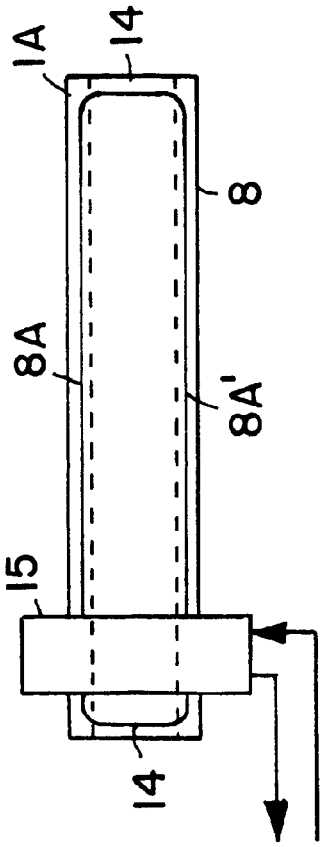
FIG. 7 is a schematic side view of a pressure hose having conductors forming a closed conductor loop cooperating with an oscillator coil according to the invention.

FIG. 7 shows a closed conductor loop 14, in which the two conductors 8A and 8A' are electrically connected to each other at both respective ends of the hose 8. Particularly, a closed loop bridge conductor or a respective hose connector at each end of the hose provides a conduction path between the two conductors 8A and 8A' at a terminal end portion 1A of the hose 8 at both ends thereof. An oscillating coil 15 arranged at the respective valve outlet 11 of the respective magnetic valve 3 has an end portion of the respective pressure hose 8 passing therethrough, and cooperates with the closed conductor loop 14 to form an oscillating resonant circuit with a prescribed or predetermined resonant frequency. This resonant frequency can be measured after the initial installation of the pressure hose 8 in a known non-defective or fully functional condition. The power consumption or dissipation of the oscillating circuit is measured and electronically monitored using any known electronic components for carrying out such a function.

A variation in the power consumption and dissipation, or in the oscillating frequency, and especially such a variation exceeding a prescribed acceptable threshold, will be interpreted by the detection circuit as a significant feature indicating a significant change in the proper functionality of the associated pressure hose 8. In other words, any physical disruption of the pressure hose 8 will correspondingly disrupt or alter the conductors 8A and 8A' included in the hose 8, which in turn will alter the resonance characteristic of the resonant circuits. Such a variation of the resonance characteristic will be interpreted and evaluated by the loom control or detection circuit 9, which in turn will release a corresponding signal that gives an indication to the operator of the loom that it may be desirable to stop the weaving process. Alternatively, the indicated or generated signal can be used directly to automatically interrupt and stop the weaving process. The circuit arrangements and other means necessary for carrying out such an automatic loom stop are well known in the art.

Another type of variation of the electrical characteristics of the electrical conductors 8A and 8A', such as an alteration of the resonant frequency of the formed resonant circuit, arises due to the aging and fatigue of the associated pressure hose 8. Namely, due to the vibration, mechanical stresses and the like, the pressure hose will exhibit a known or quantifiable deterioration over time. For example, the rubber or synthetic material of the hose wall 8' will oxidize, break down due to ultraviolet radiation, or otherwise decay. When the long term durability characteristic of the hose material is known or determined, an arrangement of conductors 8A and 8A' having a similar or related time aging characteristic can be used in the hose 8. Then, as the material of the hose 8 decays or ages, and the conductor quality similarly decays or ages over time, the gradual variation of the electrical characteristic being monitored will ultimately cause the hose defect signal to be triggered once the electrical characteristic has deviated out of an allowable range, i.e. beyond an allowable threshold.

The electrical connection of the conductors 8A and 8A' of a particular hose 8 with each other, and of these conductors 8A and 8A' to the rest of the detection system, for example to the second signal line 3B can be achieved in various manners. For example, the hose connections 10 and/or 11 themselves can be made of an electrically conducting metal, and can thereby connect the conductors to each other to form a current carrying conductor loop at the respective end or ends of the hose 8. One of the conductors 8A may be connected to a power supply to provide the input power to the conductor arrangement of the hose 8, while the second conductor 8A' is connected to the second signal line 3B, for example through the valve outlet or hose connector 11. Thus, the current will flow through the first conductor 8A and then back through the second conductor 8A' if there is no interruption in these conductors. Alternatively, the hose connection 11 of the magnetic valve 3 can form a current carrying connection between the two conductors 8A and 8A'. As a further variation, one of the electrical conductors 8A or 8A' can be connected in series with an electrical conductor or signal line that provides the actuation signal for electrically actuating the respective magnetic valve 3. In this manner, an interruption or defect in the hose 8 that disrupts the electrical conductors 8A or 8A' will also interrupt the provision of the electrical actuation signal to the corresponding magnetic valve 3, which will render that valve inoperable and immediately trigger the indication of a valve fault.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. In a fluid jet loom including a pressurized fluid supply arrangement, at least one fluid jet nozzle arrangement adapted to move a weft thread by emitting a fluid jet, and at least one flexible pressure hose connecting said pressurized fluid supply arrangement to said at least one fluid jet nozzle arrangement, an improvement wherein said flexible pressure hose comprises a hose wall and at least one electrical conductor arranged on or in said hose wall, and wherein said improvement further comprises a detection circuit that is electrically connected to said at least one electrical conductor and that is adapted to receive an electrical signal from said at least one electrical conductor and to evaluate at least one electrical characteristic of said electrical signal so as to detect the occurrence of a defect in said flexible pressure hose based on detecting a variation in said electrical characteristic.

2. The improvement in the fluid jet loom according to claim 1, wherein said pressurized fluid supply arrangement comprises a pneumatic or hydraulic fluid pressure source and at least one electrically actuatable magnetic valve connected to said pressure source, and wherein said at least one fluid jet nozzle arrangement includes a plurality of nozzle arrangements including a main weft insertion nozzle arrangement, an auxiliary nozzle arrangement, and a weft tensioning nozzle arrangement.

3. The improvement in the fluid jet loom according to claim 1, wherein said at least one electrical conductor is so arranged in relation to said hose wall such that a physical rupture of said house wall will at least alter or disrupt said at least one electrical conductor and thereby interrupt or alter the electrical signal provided from said at least one electrical conductor to said detection circuit.

4. The improvement in the fluid jet loom according to claim 1, wherein said detection circuit is further adapted to release a defect signal upon detecting the occurrence of a defect in said flexible pressure hose.

5. The improvement in the fluid jet loom according to claim 1, wherein said loom further includes an electronic loom controller, and wherein said detection circuit is incorporated in said loom controller.

6. The improvement in the fluid jet loom according to claim 1, wherein said at least one electrical conductor extends linearly along said pressure hose parallel to a longitudinal axis of said pressure hose.

7. The improvement in the fluid jet loom according to claim 1, wherein said at least one electrical conductor extends as a helical spiral about a longitudinal axis of said pressure hose.

8. The improvement in the fluid jet loom according to claim 7, wherein said at least one electrical conductor comprises a plurality of conductors forming a woven braid and at least one conductor that is isolated from said woven braid except at an end of said pressure hose.

9. The improvement in the fluid jet loom according to claim 1, wherein said at least one electrical conductor is embedded in said hose wall.

10. The improvement in the fluid jet loom according to claim 1, wherein said at least one electrical conductor is arranged on an outer surface of said hose wall.

11. The improvement in the fluid jet loom according to claim 1, wherein said pressure hose further comprises a hose connection fitting connected to said hose wall at an end of said pressure hose, said at least one electrical conductor comprises at least two conductors extending along a length of said pressure hose, and respective ends of said two conductors are electrically connected to each other at said end of said pressure hose to form a conductor loop.

12. The improvement in the fluid jet loom according to claim 11, wherein said hose connection fitting provides a conduction path between said respective ends of said two conductors, such that said respective ends of said two conductors are electrically connected to each other through said conduction path.

13. The improvement in the fluid jet loom according to claim 12, wherein said hose connection fitting is connected to a respective one of said at least one fluid jet nozzle arrangement.

14. The improvement in the fluid jet loom according to claim 12, wherein said hose connection fitting is connected to said pressurized fluid supply arrangement.

15. The improvement in the fluid jet loom according to claim 1, wherein said at least one electrical conductor comprises two conductors that are connected to each other at only one end of said pressure hose so as to form an open conductor loop.

16. The improvement in the fluid jet loom according to claim 15, further comprising a power supply, wherein a first one of said two conductors is connected to said power supply and a second one of said two conductors is connected to said detection circuit.

17. The improvement in the fluid jet loom according to claim 1, wherein said at least one electrical conductor comprises two conductors that are connected to each other respectively at two opposite ends of said pressure hose so as to form a closed conductor loop.

18. The improvement in the fluid jet loom according to claim 17, further comprising an oscillating coil arranged to electromagnetically cooperate with said closed conductor loop so as to form a resonant circuit loop, wherein said electrical characteristic comprises a frequency of oscillation in said resonant circuit loop.

19. The improvement in the fluid jet loom according to claim 18, wherein said detection circuit includes a frequency detection circuit that is adapted to evaluate said frequency of oscillation in said resonant circuit loop, and to release a defect signal upon detecting a variation in said frequency of oscillation.

20. The improvement in the fluid jet loom according to claim 1, wherein said pressurized fluid supply arrangement comprises at least one electrically actuatable magnetic valve and an electric actuating signal line, wherein said at least one electrical conductor comprises first and second conductors, and wherein said first conductor is connected in series to said electric actuating signal line.

21. The improvement in the fluid jet loom according to claim 20, wherein said second conductor is connected in series to said first conductor and to said magnetic valve.

22. A method of detecting the occurrence of a defect in a flexible pressure hose in the loom according to claim 1, comprising the following steps:

a) applying an electrical signal to said at least one electrical conductor;

b) monitoring said at least one electrical characteristic of said electrical signal using said detection circuit;

c) in said detection circuit, evaluating whether said electrical characteristic has varied past a threshold; and d) responsive to said electrical characteristic varying past said threshold, releasing a defect signal indicating that a defect has occurred in said pressure hose.

23. The method according to claim 22, further comprising stopping a weaving operation on said loom responsive to said defect signal.

* * * * *